US006776259B1

(12) United States Patent
Murten

(10) Patent No.: US 6,776,259 B1
(45) Date of Patent: Aug. 17, 2004

(54) ADJUSTABLE SAFETY CABLE

(76) Inventor: Stephen Murten, The Limes Off Old York Road, Skellow, Doncaster (GB), DN6 8LA ( * ) Notice: Subject to any disclaimer, the term of this patent is extended or adjusted under 35 U.S.C. 154(b) by 0 days.

(21) Appl. No.: 09/857,867

(22) PCT Filed: Oct. 6, 2000

(86) PCT No.: PCT/GB00/03820

§ 371 (c)(1),
(2), (4) Date: Sep. 10, 2001

(87) PCT Pub. No.: WO01/27411

PCT Pub. Date: Apr. 19, 2001

(30) Foreign Application Priority Data

| | | |
|---|---|---|
| Oct. 12, 1999 | (GB) | 9923976 |
| Jan. 12, 2000 | (GB) | 0000507 |
| Feb. 22, 2000 | (GB) | 0003970 |
| Jun. 6, 2000 | (GB) | 0013595 |

(51) Int. Cl.[7] ..... A62B 37/00
(52) U.S. Cl. ..... 182/3; 182/129
(58) Field of Search ..... 182/113, 36, 45, 182/3, 129

(56) References Cited

U.S. PATENT DOCUMENTS

| | | | | | |
|---|---|---|---|---|---|
| 318,391 | A | * | 5/1885 | Price | 182/84 |
| 2,294,240 | A | * | 8/1942 | Pollman | 52/651.1 |
| 3,880,405 | A | * | 4/1975 | Brueske | 256/59 |
| 4,037,824 | A | * | 7/1977 | Whitmer | 256/53 |
| 4,792,700 | A | * | 12/1988 | Ammons | 290/55 |
| 5,242,347 | A | * | 9/1993 | Keeton | 482/102 |
| 5,255,798 | A | * | 10/1993 | Aaldenberg et al. | 211/46 |
| 5,718,305 | A | | 2/1998 | Palmer | |
| 5,799,750 | A | * | 9/1998 | Garcia | 182/82 |
| 6,039,150 | A | * | 3/2000 | Palmer | 182/113 |
| 6,053,281 | A | * | 4/2000 | Murray | 182/113 |

FOREIGN PATENT DOCUMENTS

| | | |
|---|---|---|
| DE | 19821323 | 12/1999 |
| JP | 11036604 | 2/1999 |

* cited by examiner

*Primary Examiner*—Alvin Chin-Shue
(74) *Attorney, Agent, or Firm*—James Creighton Wray; Meera P. Narasimhan

(57) ABSTRACT

The disclosed safety apparatus for the erection of structure and method for erection thereof comprises a first substantially vertical support, a second substantially vertical support and a supporting cable extending between said first and second supports, wherein said vertical supports are configured to be adjustable in length and each includes a first fixing means and a second fixing means such that the length of a support may be adjusted by releasing said first fixing means and then re-fixing said first fixing means after said adjustment has been made.

19 Claims, 12 Drawing Sheets

ADJUSTABLE SAFETY CABLE

BACKGROUND OF THE INVENTION

In order to erect structures such as buildings, scaffoldings are usually required to be erected prior to any other work carried out on the building itself.

People who erect scaffoldings are known in the art as scaffolders and are required to erect such scaffolds in conditions that, by necessity, place them at risk of falling from a relatively high elevation during the course of their work.

1. Field of the Invention

The present invention relates to a safety apparatus for the erection of structures, which provides safety to users before they are placed at risk.

2. Description of the Related Art

Numerous types of safety apparatus exist to prevent such occurrences, such as described in United Kingdom Patent 2 311 554. However, such systems require the scaffolder to first escalate the scaffold, irrespective of its height without the benefit of being safely attached to any safety apparatus, and only being able to anchor himself to said safety apparatus once he has reached his area of work.

Such a problem is encountered both at the time of climbing onto the scaffold, for instance at the beginning of the working day and, subsequently, also at the time of coming off the scaffold, for instance at the end of the working day. Moreover, each time a higher level of scaffolding requires erecting, scaffolders are hence required to climb up the scaffolding and existing apparatus do not allow them to do so whilst benefiting from being safely attached to any safety apparatus. Indeed, a scaffolder must first release his anchor from said safety apparatus, then climb up to the new level of scaffolding whereafter he ran secure the existing apparatus in place, said scaffolder being constantly at risk of falling. Only then can he and his co-workers anchor to said safety apparatus.

BRIEF SUMMARY OF THE INVENTION

According to a first aspect of the present invention, there is provided a safety apparatus for the erection of structures, comprising a first substantially vertical support; a second substantially vertical support; and a supporting cable extending between said first and second supports, wherein said vertical supports are configured to be adjustable in length and each includes a first fixing means and a second fixing means such that the length of a support may be adjusted by releasing said first fixing means and then refixing said first fixing means after said adjustment has been made. The invention therefore provides a means for providing constant safety to said scaffolder such that he is constantly tethered to said safety apparatus whilst scaling and erecting scaffoldings, independently of the height that said scaffold must be erected to:

According to a second aspect of the invention, there is provided a method of erecting safety apparatus during the assembly of a structure, comprising the steps of attaching the first substantially vertical support to said structure; attaching the second substantially vertical support to said structure; extending a cable between said first and second supports and attaching a safety harness to said cable, wherein said vertical supports are configured to be adjustable in length and each includes a first fixing means and a second fixing means such that the length of a support may be adjusted by releasing said first fixing means and then refixing said fixing means after said adjustment.

The invention will now be described by way of example only with reference to the following drawings.

BEST MODE FOR CARRYING OUT THE INVENTION

Figure 1:
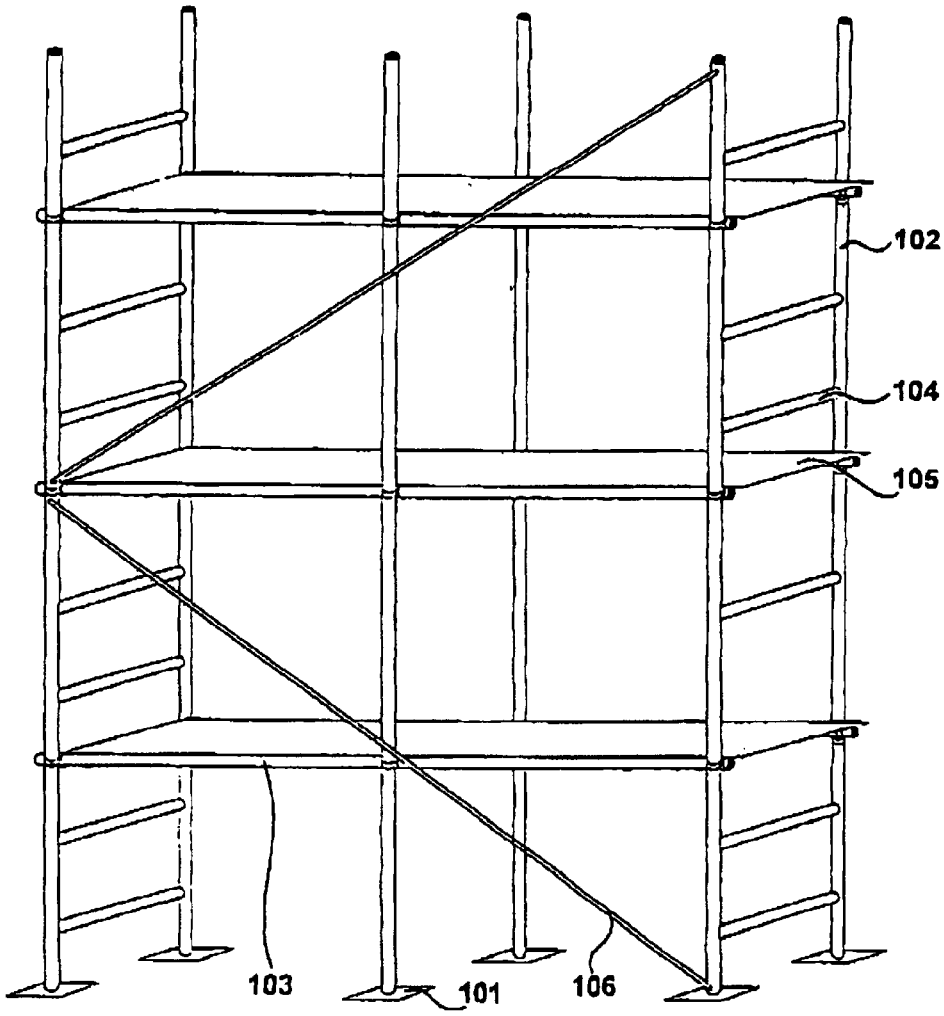
FIG. 1 is an isometric view of a scaffold erected.

FIG. 1 shows a scaffold 101, comprising of vertical poles 102, horizontal poles 103, transversal poles 104 and flat sections 105. It also comprises diagonal strengthener poles 106.

Typically, the erection of the scaffold requires firstly, the erection of the vertical poles 102 and secondly, fitting of the horizontal poles 103. Transversal poles 104 are then implemented to confer additional stability and integrity to the scaffold before the flat sections 105 are put in place. The diagonal strengthener pole 106 are then implemented to confer additional stability and integrity to the ensemble.

Current safety apparatus for scaffolders who erect this type of structure consists mainly of a lanyard tethering a safety harness worn by the scaffolder to any of the scaffold poles that constitute the scaffold. Such a lanyard is typically five feet length, thus restricting the working area for any scaffolder wearing this safety apparatus to five feet either side of the anchoring paint of the lanyard.

Upon completing work necessary to the erection of a higher flat surface, which can be partially achieved whilst standing on the flat surface immediately underneath, a scaffolder must then unhook his lanyard from its anchoring point on the scaffold, climb to the new higher level of the scaffold untethered at the risk of falling from the scaffold in order to reach the parts of the ensemble that requires further work, such as tightening bolts or fixtures, and then set up the safety apparatus again.

Once in place, he can then tether his lanyard to safety apparatus and carry out further tasks. Alternatively, should other scaffolders be working on said scaffold with the first scaffolder, they also must unfasten their lanyard from safety apparatus and climb to the higher lever untethered, at the risk of falling from the scaffold.

Figure 2:
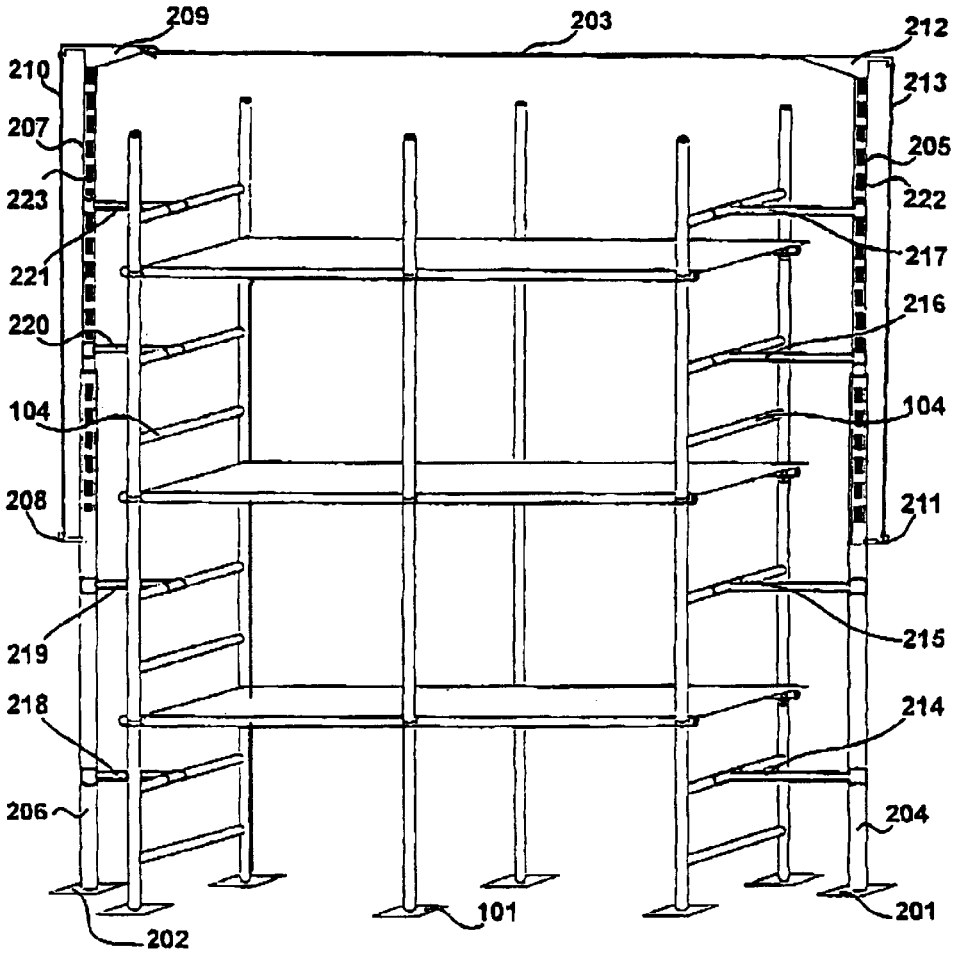
FIG. 2 is an isometric view of a scaffold erected, with the safety apparatus in place.

FIG. 2 shows the same scaffold 101 fully erected and equipped with the present invention.

A first substantially vertical support 201 consists of a lower tube 204 and an upper tube 205. Said lower tube 204 has a larger diameter than upper tube 205 so that upper tube 205 may slide vertically within said lower tube 204. The lower tube 204 is attached to transversal poles 104 of scaffold 101 by way of second fixing means 214 and 215. The upper tube 205 is attached to transversal poles 104 of scaffold 101 by way of first fixing means 216 and 217.

The upper tube 205 features an anchoring head 211 located at its lower extremity and protruding from the lower tube 204 through a slot implemented along at least part of the length of lower tube 204. Upper tube 205 also includes an internal strengthener component 222, the section of which can be square, triangular or dodecahedral. An external strengthener component 213 extends between the lower anchoring point 211 arc an upper anchoring point 212 situated at the upper extremity of upper tube 205. A supporting cable 203 extends between said first substantially vertical support 201 and a second substantially vertical support 202.

Said substantially vertical support 202 has an identical structure to first substantially vertical support 201 in that it includes a lower tube 206 and an upper tube 207, the diameter of said lower tube 206 being larger than that of upper tube 207 so as to enable the upper tube 207 to slide vertically within lower tube 206. The upper tube 207 features an anchoring point 208 at As lower extremity and an anchoring point 209 situated at its upper extremity. Upper tube 207 also includes an internal strengthener component 223, the section of which can be square, triangular or dodecahedral. An external strengthening cable 210 extends between both anchoring points. The lower tube is attached to transversal poles of scaffold is 101 by way of second fixing means 218 and 219 and upper tube 207 is attached to transversal poles of scaffold 101 by way of first fixing means 220 and 221.

Figure 3:
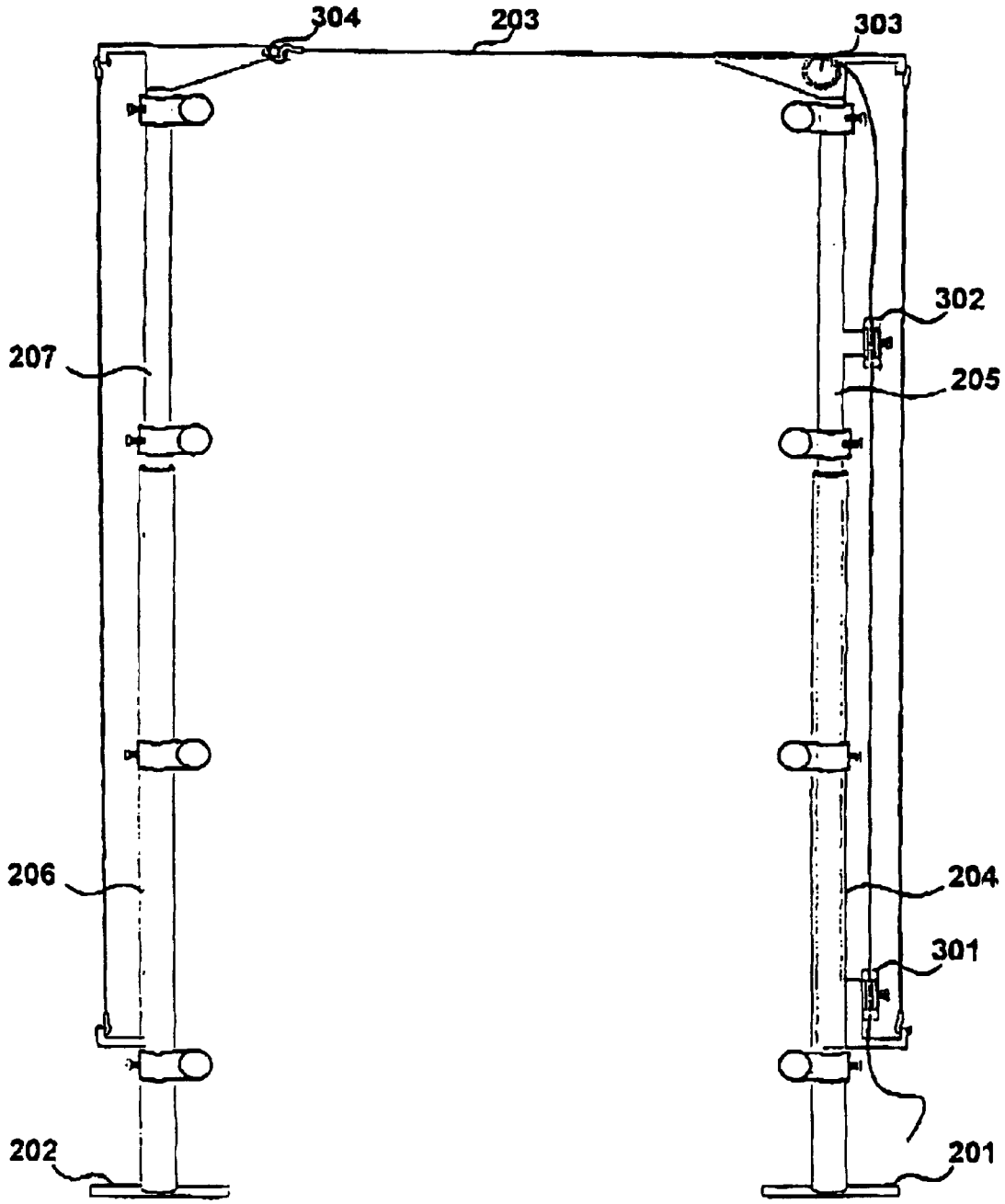
FIG. 3 is a side view of the first and second substantially vertical supports and of the supporting cable of said safety apparatus, which embodies the present invention.

FIG. 3 provides a more detailed view of the anchoring means for the supporting cable 203 extending between said first and second supports.

Supporting cable 203 passes through a first clamping device 301 located on the anchoring point 211 which is itself located on the lower extremity of the upper tube 206 of the first substantially vertical support 201. The supporting cable 203 then passes through a second damping device 302 identical in all points to damping device 301. Clamping device 302 is rigidly attached to upper tube 205. Supporting cable 203 is then further supported by pulley 303 implemented at the upper extremity of upper tube 205, which translates the direction of the safety cable from a vertical direction to a horizontal direction. Supporting cable 203 then extends between said upper extremity of the upper tube 205 of the substantially vertical support 201 and the upper extremity of upper tube 207 of second substantially vertical support 202.

The second substantially vertical support 202 is identical in structure and components to the first substantially vertical support 201 but does not feature a first or a second clamping device. However, the upper tube 207 features attachment means 304 at its upper extremity in order to safely anchor the extremity of the supporting cable 203.

Figure 4:
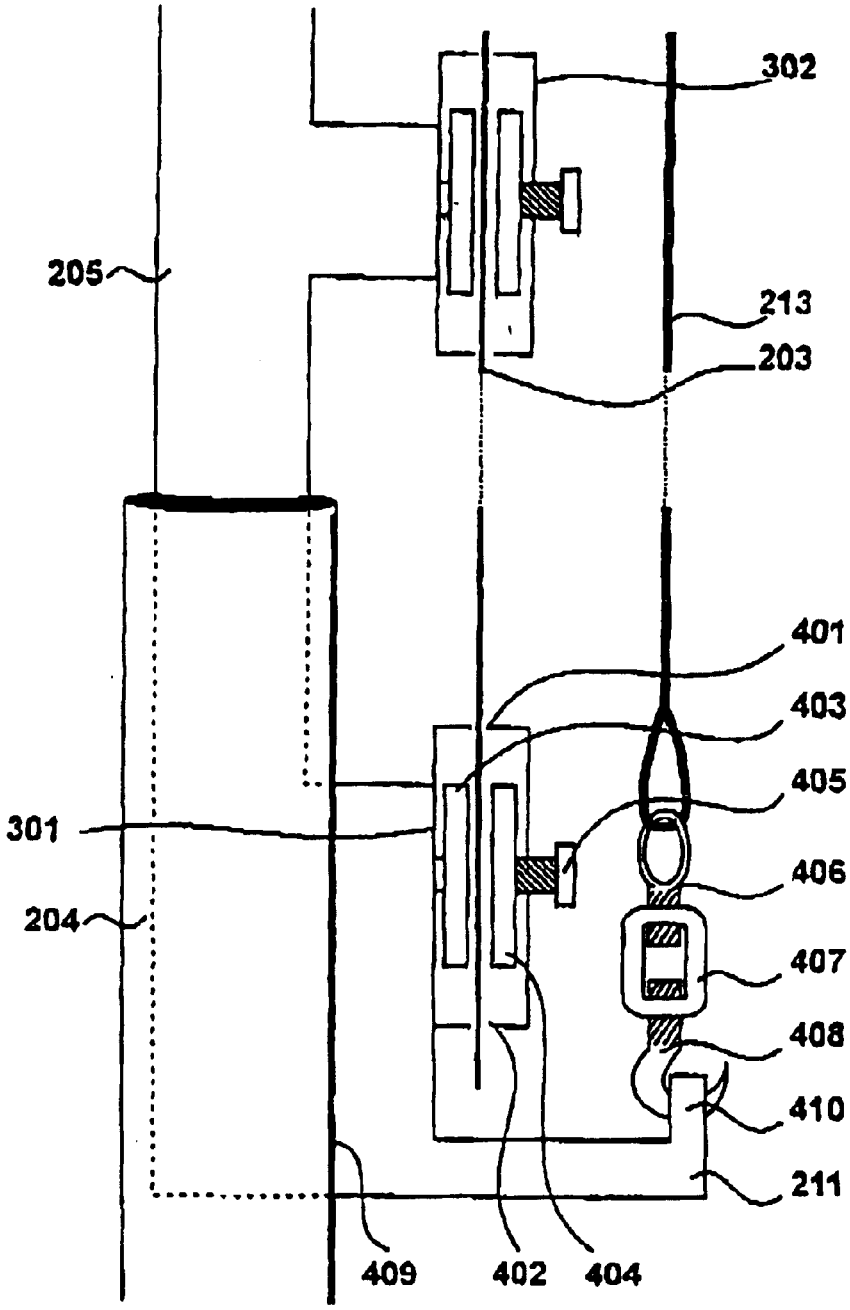
FIG. 4 is a side view of a detail of the first substantially vertical support of said safety apparatus, illustrating the anchoring of the supporting cable and the external strengthener component at the base of an upper tube of said first substantially vertical support.

FIG. 4 provides a more detailed view of the clamping devices implemented to secure the supporting cable 203 as well as the external strengthening cable 213. Anchoring point 211 is an integral part of upper tube 205 and protrudes from a slot 409 implemented along at least part of the length of lower tube 204. Clamping device 301 features an upper opening 401 through which supporting cable 203 enters the clamping device. It also features a lower opening 402 through which the cable exits the clamping device. The clamping operation is implemented by way of an anterior plate 403 against which supporting cable 203 is clamped by a posterior plate 404. The posterior plate 404 is pressed against the cable and the anterior plate 403 by way of a tightening screw and bolt combination 405.

The supporting cable 203 then passes through a second damping device 302, which is identical in all points to the damping device 301.

Supporting cable 203 is tensed once h has been threaded through clamping devices 301, 302 and safely anchored to anchoring point 209, and is clamped in place by tightening the screw and bolt combination 405. In effect, clamping device 302 provides the primary damping point, whereas clamping device 301 assumes the function of a redundant, additional safety clamping point should the primary damping device 302 fail.

Part of the anchoring point 211 protrudes and a cavity 410 is implemented at the extremity of this protuberance in order to facilitate the anchoring of the external strengthener component 213 to said anchoring point. Said external strengthener component 213 is attached to a first loop 406 that includes a threaded extremity, said threaded extremity is screwed to one end of a double-ended tightening loop 407, a hook 408 also including a threaded extremity is screwed to the other end of the double ended tightening loop 407. The sharp end of said hook 408 is then passed through the cavity 410. Upon rotating the double-ended tightening loop 407, the tension of the external strengthening cable 213 is increased and therefore increases the overall rigidity and integrity of the upper tube 205.

Figure 5:
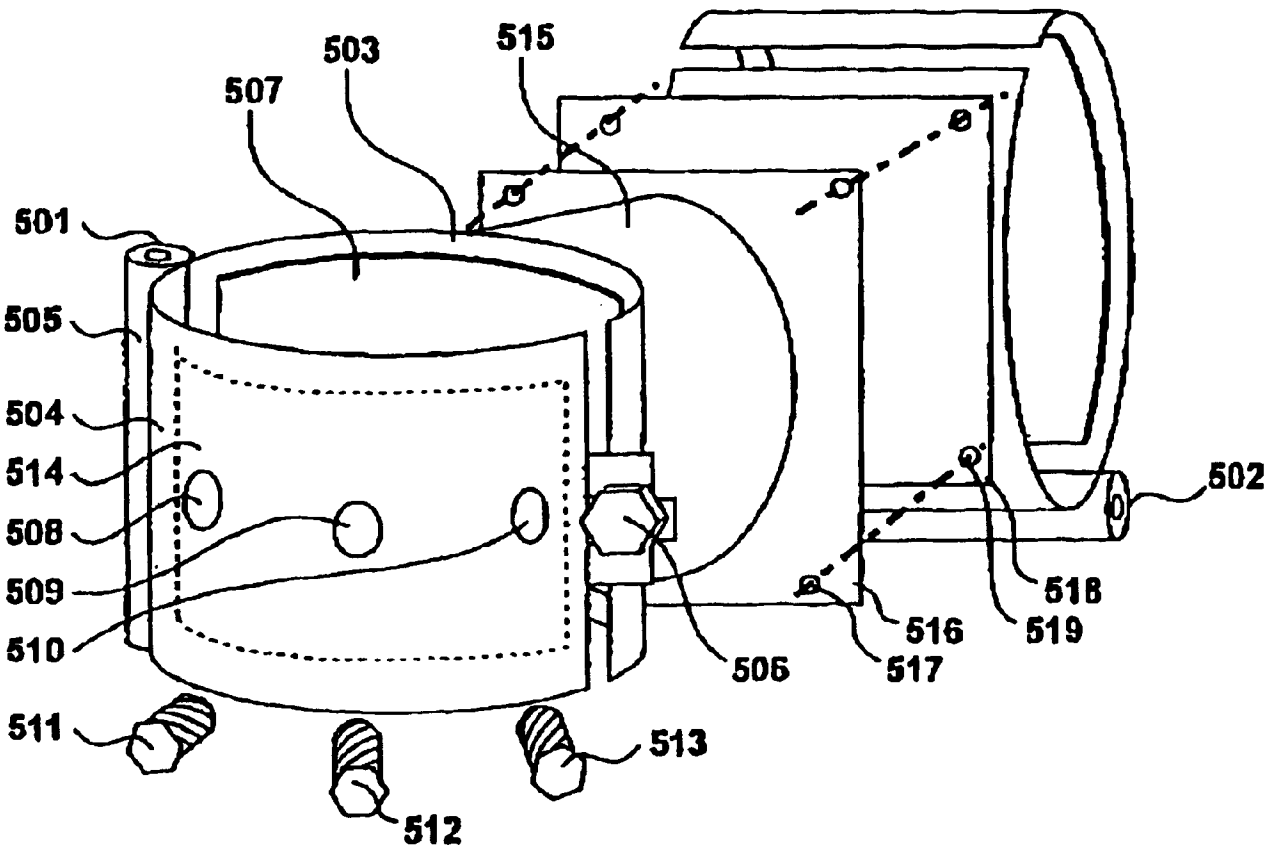
FIG. 5 is a perspective view of the device which embodies first and second fixing means.

FIG. 5 illustrates a perspective view of said first and second fixing means 214, 215, 216, 217, 218, 219, 220 and 221. Said fixing means comprise two cylindrical brackets 501 and 502, diametrically opposed such that bracket 501 is secured around substantially vertical support 201 and bracket 502 is secured around any pole forming part of scaffold 101, preferably a transversal pole, such as transversal pole 104. Said bracket 501 comprises a first halt cylinder 503 and a second half cylinder 504 articulated by a hinge 505. Said half cylinders 503 and 504 may be clasped together by way of locking means 506.

The half cylinder 503 features an inner plate 507 with a permanent layer of PTFE material implemented to confer the apparatus increased grip over the substantially vertical support. The second half cylinder 504 which faces the outside of said substantially vertical support features three threaded holes 508, 509 and 510, preferably equidistant from one another and implemented on an imaginary line dividing the half cylinder 504 along the sense of its curve. Screw devices 511, 512 and 513 have a thread that compliments the thread implemented in openings 508, 500 and 510.

An internal plate 514 with a curvature sensibly similar to the curve defined by the half cylinder 504 is pressed, against said substantially vertical support by way of screwing and thereby tightening screw device 511 into opening 508, screw device 512 through opening 509 and screw device 513 through opening 510, at which point they apply pressure against the curved plate 514, which itself clasps said substantially vertical support against plate 507.

Said bracket 501 is mounted by way of welding, or other appropriate process, to an extension arm 515, the section of which is substantially but non-exclusively circular. Said extension arm 515 is itself mounted onto a base square plate 516 by way of welding, or any other appropriate means. Said base square plate 516 has threaded holes 517 implemented at each of its four comers.

An additional bracket 502, identical in all points to first bracket 501, is fixed to bracket 501 by bolting together their respective base square plates 516 and 518 through the four threaded openings 517 on square plate 516 and corresponding threaded openings 519 on square base plate 518. Said bracket 502 is fixed to bracket 501 in such a way that the cylinders respectively delimited by brackets 501 and 502 are perpendicular to one another. Thus, we have described fixing means of the type erred to in FIG. 2 as 214, 215, 216, 217, 218, 219, 220 and 221, which enable the safe anchoring of the ensemble of the substantially vertical supports to transversal poles, which are a strengthening part of scaffold 101 themselves.

Figure 6:
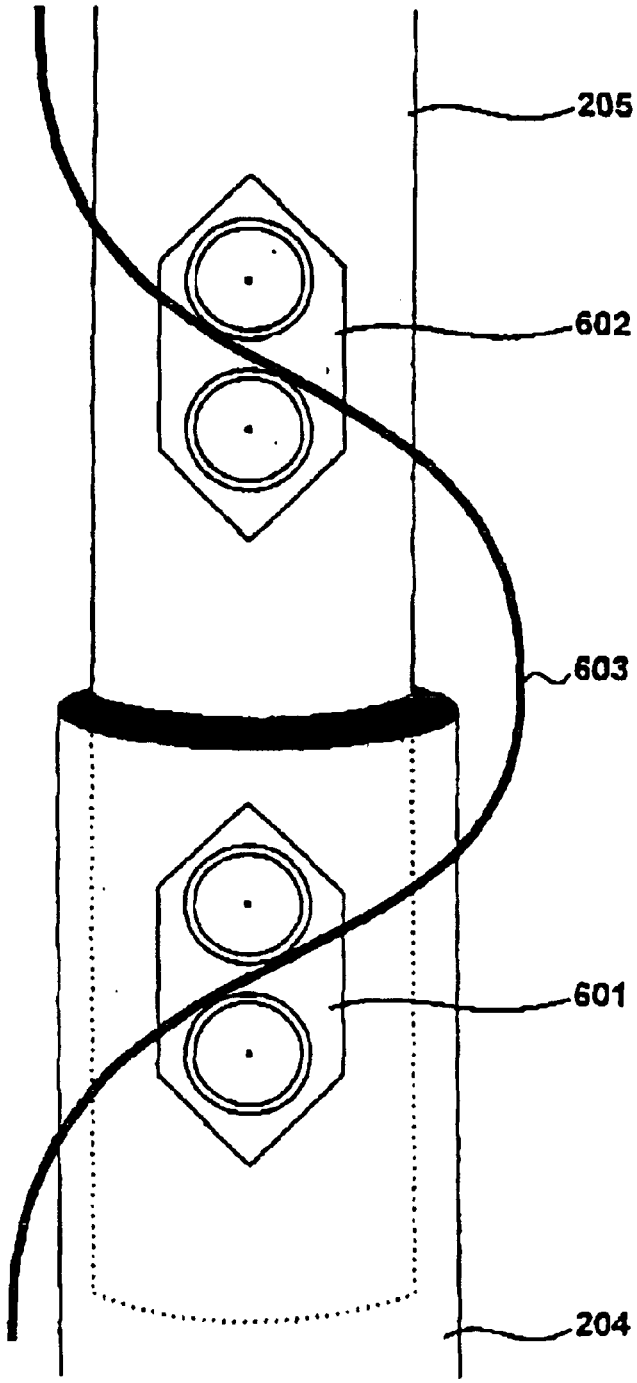
FIG. 6 is a side view of a system of pulleys and rope combination, used to adjust the height of both an upper and lower tube of a substantially vertical support relative to on another.

FIG. 6 shows an implementation of a system of pulleys and rope combination, which is used to slide upper tube 205 independently of lower tube 204. Said system comprises a first ensemble of pulleys 601, rigidly fixed to lower tube 204 of first substantially vertical support 201. Said system also comprise a second ensemble of pulleys 602, itself rigidly fixed to upper tube 205 of first substantially vertical support 201. A rope 603 passes through both ensembles of pulleys 601 on lower tube 204 and 602 on upper tube 205 and is threaded through said ensemble of pulleys in such a way that pulling on said rope 603 would raise upper tube 205 independently of lower tube 204 and feeding the rope through the ensemble of pulleys would, on the contrary, lower upper tube 205 within lower tube 204. Alternatively, should rope 603 be manoeuvred above the lower tube 204, the effect of pulling rope 603 through the ensemble of pulleys 601, 602 would raise the lower tube 204 independently of upper tube 205 and feeding said rope 603 through the ensemble of pulleys 601, 602 would lower lower tube 204 independently of upper tube 205.

The second substantially vertical support 202 is equipped with an identical system of pulleys and rope combination, in order to adjust the height of both substantially vertical supports 201 and 202 such that the supporting cable 203 remains parallel to the structure and is attached at all times.

Figure 7:
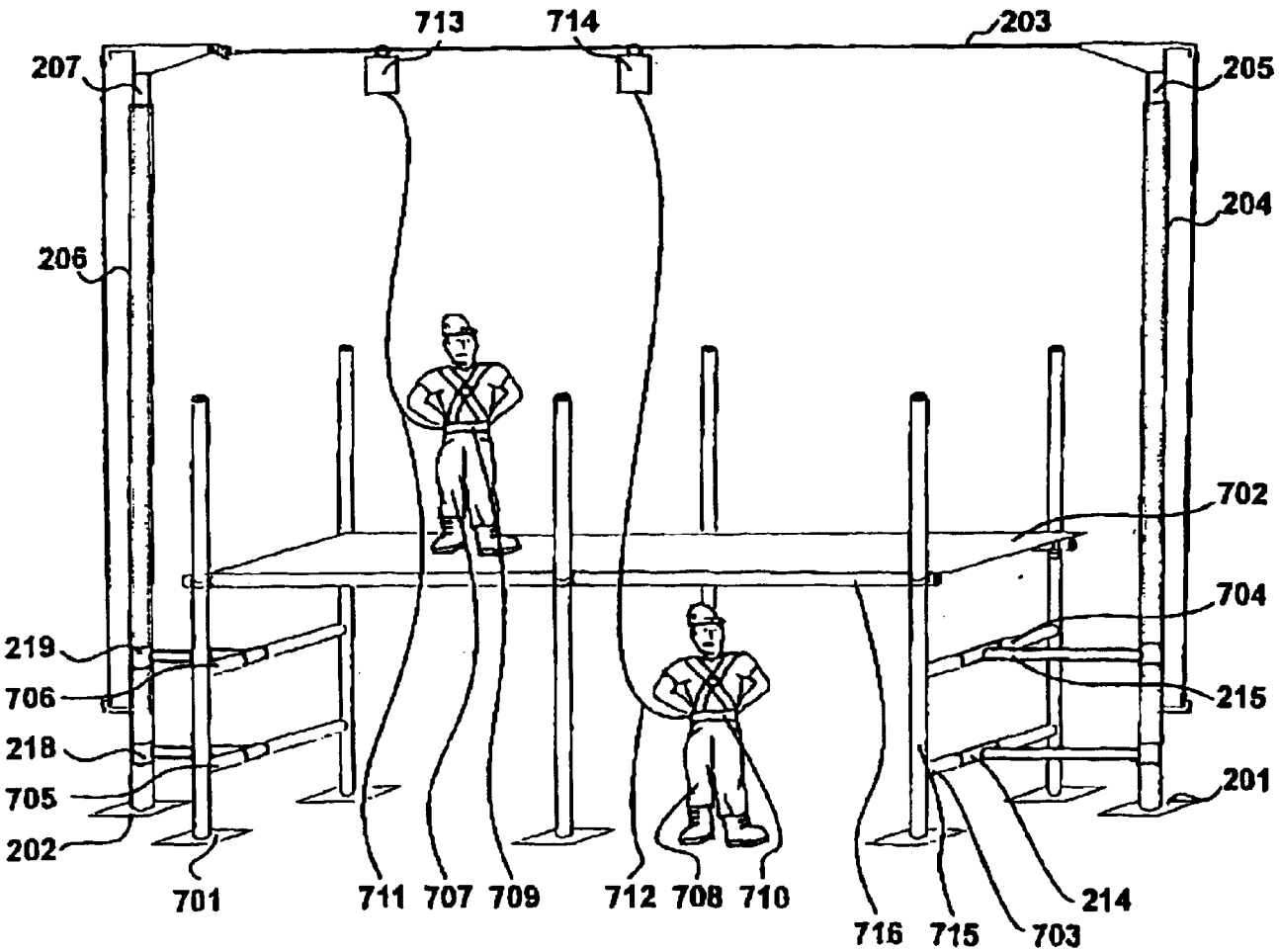
FIG. 7 is an isometric view of a first level of scaffolding with the safety apparatus in place.

FIG. 7 shows the first erected level of a scaffold 701, which typically does not yet require scaffolders to equip themselves with any safety device, said structure being typically under six toot high.

Said scaffold comprises a combination of vertical poles 715 and horizontal poles 716 and four transversal poles 703, 704, 705 and 706. It further comprises flat surface 702, typically wooden planks resting on the ensemble delimited by the poles so that scaffolders, fitters or builders, can manoeuvre and carry out their working tasks on the scaffold. The safety apparatus is implemented at this stage of the erection of the structure.

The safety apparatus comprises a first substantially vertical support 201, itself comprising a lower tube 204 and an upper tube 205, said lower tube 204 having a bigger diameter than said upper tube 205, so as to allow upper tube 205 to slide vertically within lower tube 204.

The safety apparatus also comprises a second substantially vertical support 202 of a structure similar to first substantially vertical support 201 in that it includes a lower tube 206 and an upper tube 207, said lower tube 206 having a larger diameter than upper tube 207, so as to allow upper tube 207 to slide vertically within lower tube 208.

A safety cable 203 extends between first substantially vertical support 201, which is attached to scaffolding 701 by way of second fixing is means 214 and 215 respectively bracketing transversal poles 703 and 704, and second substantially vertical support 202, which is attached to scaffolding 701 by way of second fixing means 218 and 219, respectively bracketing transversal poles 705 and 706.

Said safety apparatus is implemented at this stage of the erection of the structure to enable scailolders to attach their respective safety harnesses to the apparatus whilst still being on the ground, thereby benefiting from the safety conferred by the apparatus as soon as the scaffolders start escalating said structure.

A scaffolder 707 equipped with a safety harness 709 is depicted as stood on flat surface 702. He is tethered to safety cable 203 by way of a cable 711 attached to a cable clamping device 713, preferably of the type known as inertia reel. Another scaffolder 708, equipped with a safety harness 710 is tethered to safety cable 203 by way of a cable 712 attached to a cable clamping device 714, also preferably of the type known as inertia reel, is depicted still on the ground.

Safety cable clamping devices 713 and 714 are preferably of the type known as inertia reel for the purpose of enabling a scaffolder 708 to secure his harness 710 to the safety cable 203 whilst still on the ground before climbing onto the scaffold 701 and putting himself at risk of subsequently falling from a high elevation.

Said inertia reel is well known to those skilled in the art and is designed to function along the same principle as a car safety belt. It will allow an attachment cable to unreel in the case of a scaffolder escalating or descending from a structure such as a scaffold, but it will prevent the cable from unreeling in the case of an abrupt cable tension such as may arise in an accidental fall from said structure.

Thus, before erecting the safety apparatus, handlers will ensure that the respective leads of the attachment cables of said inertia reels 713 and 714 are secured to any anchoring means on the ground, so that, upon completing the setting up of the safety apparatus, scaffolder 708 can safely attach the lead of inertia reel 714 to his safety harness 710 and scale scaffold 701 to reach the position of scaffolder 707 in total safety.

Figure 8:
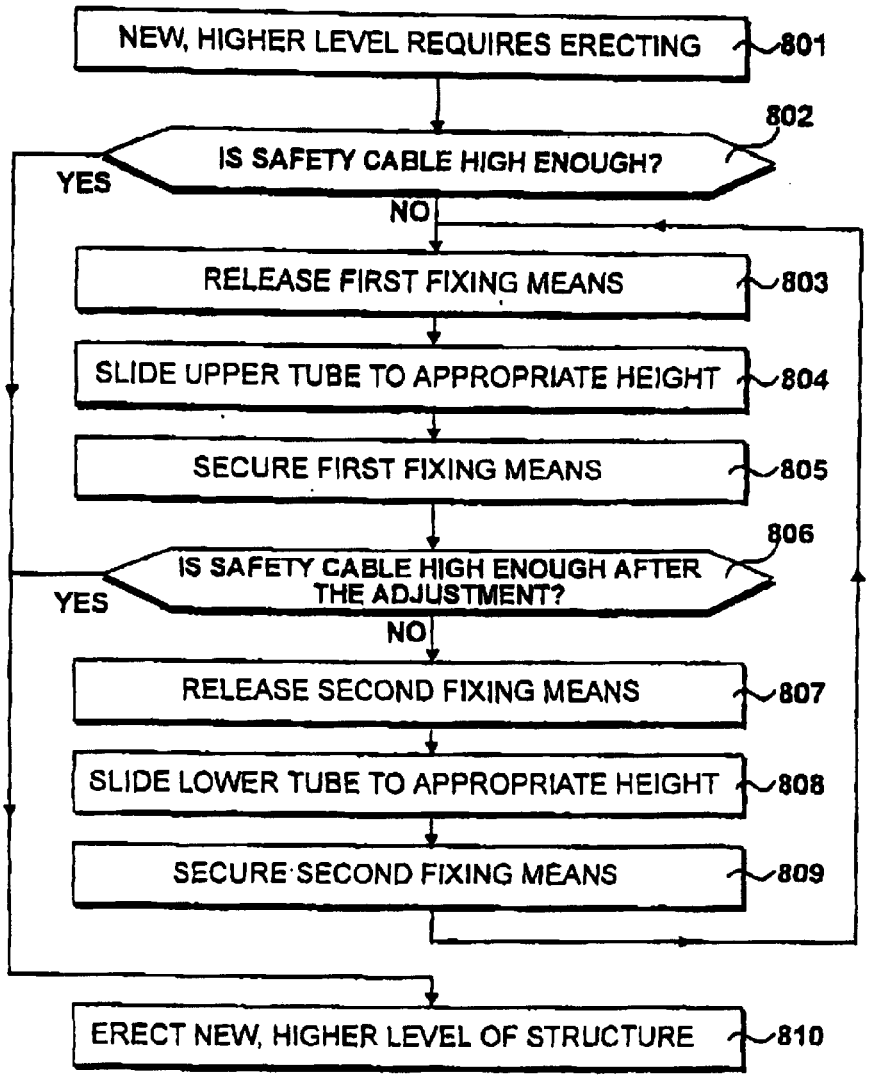
FIG. 8 details steps performed to adjust the length of the substantially vertical supports.

The safety cable 203 must always stand above the head of the scaffolders. Therefore, as the structure is being erected, the height of safety cable 203 relative to the height of the scaffolders at work will subsequently have to be adjusted. FIG. 8 details the steps required to adjust the height of said safety cable appropriately.

At step 801 it is determined that a new, higher level of structure requires erecting. At step 802 the question is asked as to whether the safety cable and therefore the safety apparatus in its ensemble is high enough to remain above the head of the scaffolders and thereby provide safety once the new, higher level has been erected. If answered in the affirmative, said new higher level can be built at step 810 without proceeding with any further adjustments of the safety apparatus. However, if answered in the negative, the safety apparatus requires adjustment so that said safety cable will still be above the head of the scaffolder once the new higher level has been erected.

At step 803 the first fixing means 216 and 217 are released so as to enable upper tube 205 of first substantially vertical support 201 to slide vertically within lower tube 204 by way of the system of pulleys and rope combination 601, 602, 603 until such time as it reaches an appropriate height at step 804. At step 805 the first fixing means 215 and 217 are then re-fixed to the structure and secured again. This three-step procedure is repeated with the first fixing means 220 and 221 of upper tube 207 of second substantially vertical support 202.

At step 806 a question is asked as to whether the safety cable is now high enough after the adjustment has taken place for the work to be carried out. When answered in the affirmative the new higher level of the structure can be erected as at step 810. However, should safety cable 203 and the safety apparatus still not reach the required height, for instance if the maximum elevation of the safety apparatus stood on the ground has been reached, then at step 807 the second fixing means 214 and 215 are released so as to enable lower tube 204 of first substantially vertical support 201 to slide vertically over upper tube 205 by way of the system of pulleys and rope combination 601, 602, 603 until such time as it reaches an appropriate height at step 808. At step 806 the second fixing means 214 and 215 are then re-fixed to the structure and secured again. This three-stop procedure is repeated with the second fixing means 218 and 219 of lower tube 206 of second substantially vertical support 202. At which point the operation reverts back to step 803 where the first fixing means, located an the upper tubes are released, the upper tubes can slide upwards to achieve the required height and the first fixing means are secured in place. Thus, the appropriate height for the safety apparatus is now achieved and the new higher level of the structure can be erected.

Throughout the nurse of the adjustment that has been described, the scaffolders carrying out this adjustment and erecting said structure still benefit from a safe tethering to safety cable 203 that will prevent any accidental fall from said structure.

Figure 9:
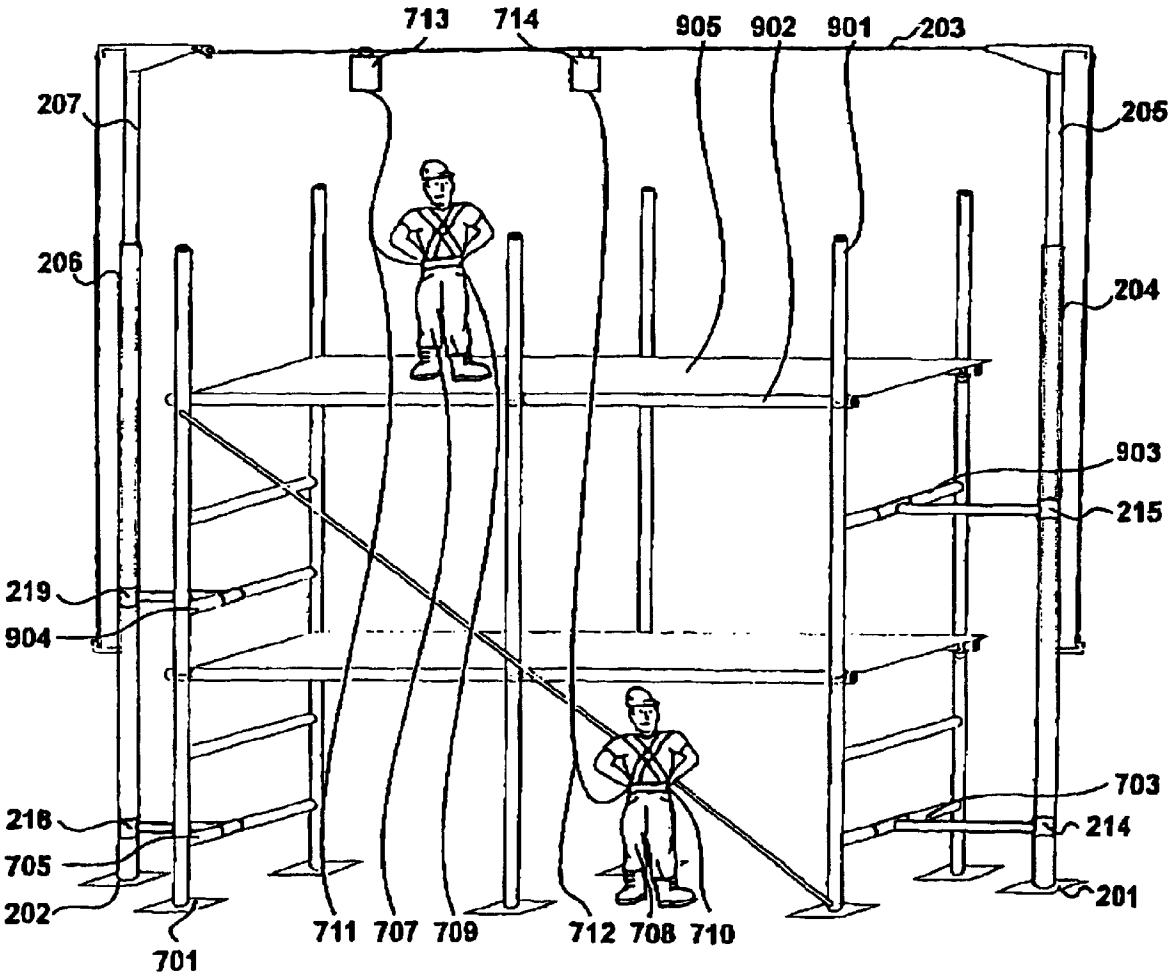
FIG. 9 is an isometric view of a first and second level of scaffolding with the safety apparatus in place, wherein the length of sad safety apparatus has been adjusted.

FIG. 9 shows a scaffold 701 from FIG. 7 where an additional higher level of scaffold has been implemented by way of vertical poles 901, horizontal poles 902, transversal poles 903 and 904 and flat surface 904. At this stage, the height of the scaffold does not yet require upper tubes 205 and 207 to be attached to the structure. The height of the safety cable 203 has however been adjusted with regard to its respective heights as depicted in FIG. 7 and said adjustment has been carried out by way of a system of pulleys and rope combination 601, 602, 603. Additionally, further integrity has been provided to the safety apparatus by releasing second fixing means 215 and 219 from their anchoring to transversal poles 704 and 706 respectively, and re-anchoring to new, higher transversal poles 903 and 904.

Scaffolder 707 has been able to carry out all the aforementioned adjustments in total safety. Moreover, scaffolder 708 is still able to anchor his harness 710 to safety cable 203 by attaching the lead of attachment cable 712 on inertia reel 714 whilst still on the ground.

FIG. 10 again shows a scaffold 701 from FIGS. 7 and 9, where an additional higher level of scaffold has been implemented by way of vertical poles 1001, horizontal poles 1002, transversal poles 1003, 1004, 1005, 1006, 1008 and 1009 and flat surface 1007. At this stage, the height of the scaffold does require upper tubes 205 and 207 to be attached to the structure, by attaching first fixing means 216 and 217 to transversal poles 1003 and 1004 respectively, and attaching first fixing means 220 and 221 to transversal poles 1005 and 1006 respectively. The height of the safety cable 203 has initially been adjusted with regard to its restive heights as depicted in FIGS. 7 and 9 and said adjustment has been carried out by way of a system of pulleys and rope combination 601, 602, 603. The safety apparatus is here depicted as having reached its maximum extension, which reaches generally between five and ten meters, preferably reaches seven meters.

Scaffolder 707 has been able to carry out all the aforementioned adjustments in total safety. Moreover, scaffolder 708 is still able to anchor his harness 710 to safety cable 203 by attaching the lead of attachment cable 712 on inertia reel 714 whilst still on the ground.

Figure 10:
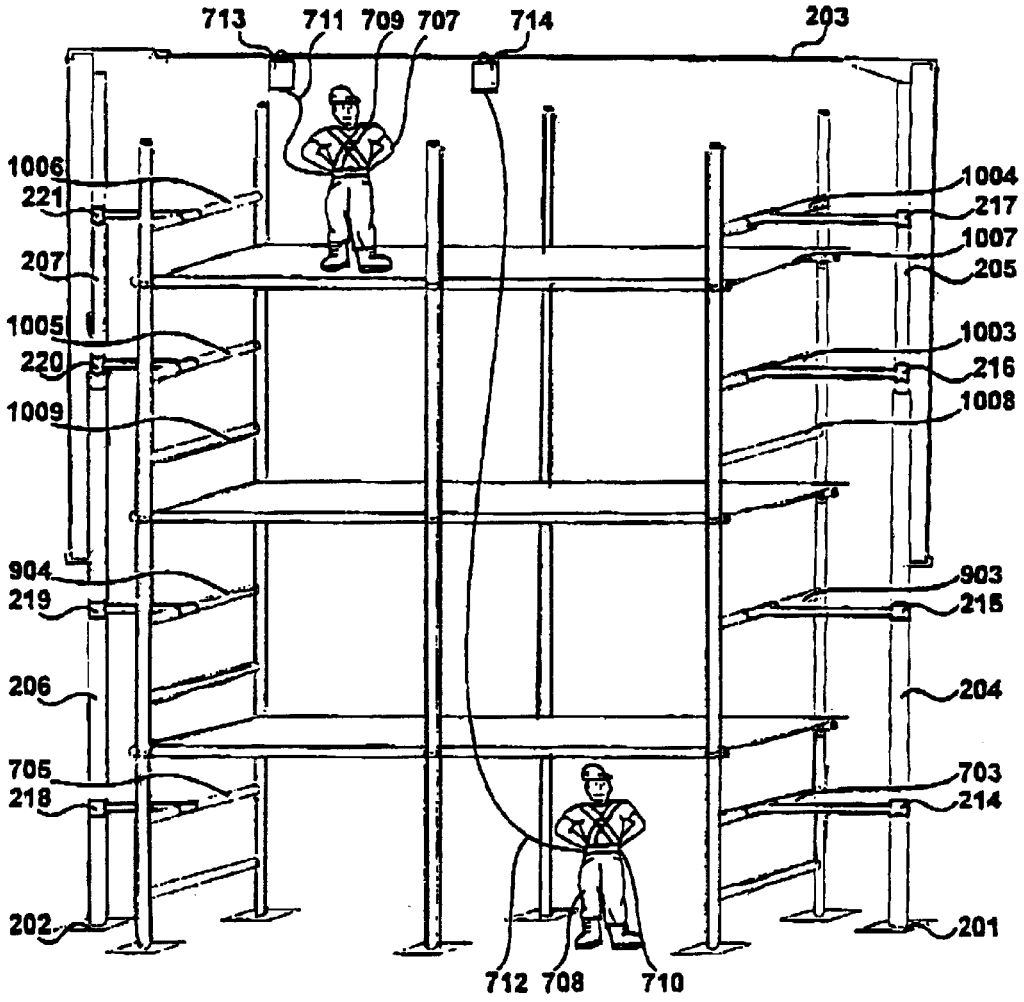
FIG. 10 shows a first, second and third level of scaffolding with the safety apparatus in place, wherein the length of said safety apparatus has a been adjusted and said safety apparatus is extended to its maximum length.
Figure 11:
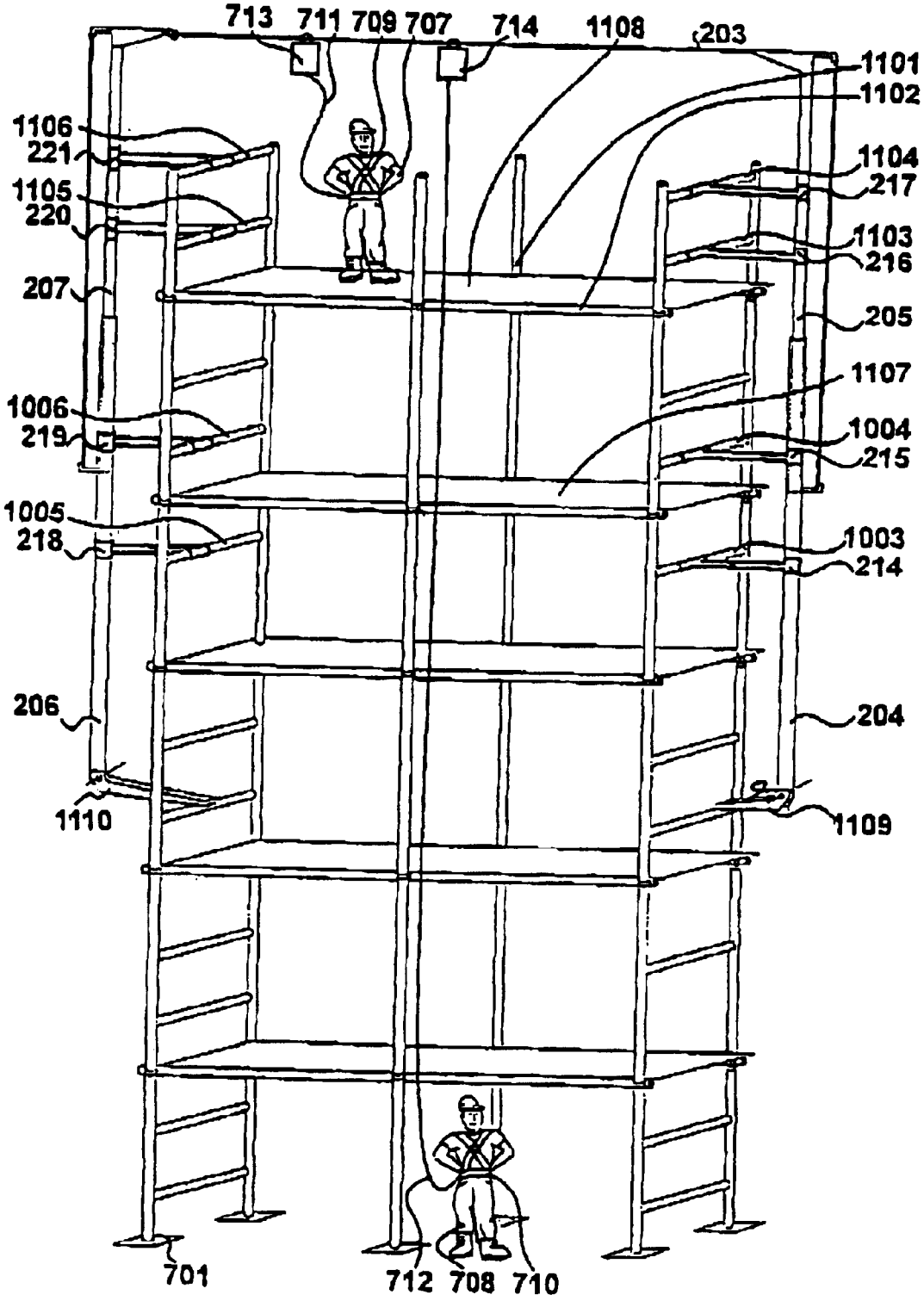
FIG. 11 is an isometric view of a scaffold featuring multiple levels with the safety apparatus in place, wherein the length of said safety apparatus has been adjusted.

FIG. 11 again shows a scaffold 701 from FIGS. 7, 9 and 10, where additional higher levels of scaffold have been implemented by way of vertical poles 1101, horizontal poles 1102, transversal poles 1103, 1104. 1105 and 1106 and flat surfaces 110 and 1108. At this stage, the height of the scaffold has required the length of the safety apparatus to be adjusted such that supporting cable 203 is elevated to a height beyond the maximum elevation of said safety apparatus whilst the lower extremities of the respective lower tubes of its two substantially vertical supports rest on the ground. Steps 801 to 810 have therefore been followed and, in order to arrive at the situation represented in FIG. 11, the following actions have successively taken place;

In order erect further levels of scaffold 701 it is determined that the safety cable will not be high enough after the adjustment as at step 806, since the safety apparatus has already reached its maximum extension. The second fixing means 214 and 215 are therefore released from the transversal poles 706 and 903 respectively. Alternatively, first fixing means 216 may also be released from transversal pole 1003 in order to slide lower tube 204 further up than what would be the case if this particular first fixing means was left in place. Lower tube 204 then slides upwards along the length of upper tube 205 by way of the system of pulleys and rope combination 601, 602 and 603. Second fixing means 214 and 215 are then respectively refixed to transversal poles 1003 and 1008. The above operation is then repeated for the second substantially vertical support, the second fixing means 218 and 219 of which are released from the transversal poles 705 and 904 respectively. Alternatively, first fixing means 220 may also be released from transversal pole 1005 in order to provide more clearance to slide lower tube 206 further up along the length of upper tube 207. Said lower tube 206 then slides along in an upward direction along the length of upper tube 207. Second fixing-means 218 and 219 are then respectively secured to transversal poles 1005 and 1009.

Subsequently, first fixing means 217 is released from transversal pole 1004 and the length of the safety apparatus is adjusted by way of the system of pulleys and rope 601, 602 and 603. Similarly, first fixing means 221 is released from transversal pole 1006 and the length of the second substantially vertical support is likewise adjusted so that supporting cable 203 reaches an appropriate height above the head of the scaffolders.

A new level of structure delimited by flat surface 1107 can now be erected. Upon erection of this level the length of the safety apparatus is again adjusted by way of the system of pulleys and rope combination 601, 602 and 603. Upon completing this adjustment a new higher level of scaffold 701 which is delimited by flat surface 1108 can now be erected.

Upon completion of the assembly of this new higher level, first fixing means 216 and 217 of upper tube 205 can now be attached to transversal poles 1103 and 1104 respectively. Likewise, first fixing means 220 and 221 of upper tube 207 can now be attached to transversal pole 1105 and 1106 respectively.

Thus, we have now described a method of erecting safety apparatus during the assembly of a structure which comprise the steps of attaching a first substantially vertical support 201 to said structure, to attach the second is substantially vertical support 202 to said structure, to extend a supporting cable 203 between said first and second substantially vertical supports 201, 202 and attach a safety harness 709 or 710 to said supporting cable 203, wherein said vertical support 201, 202 are configured to be adjustable in length and each includes a first fixing means 216, 211, 220, 221 and a second fixing means 214, 215, 218, 219, such that the length of a support may be adjusted by releasing said fixing means and then re-fixing said fixing means after said adjustment as according to steps 801 to 810.

In a preferred embodiment of the present invention, substantial vertical support 201 is equipped with spring-loaded supporting foot 1109. Said supporting foot 1109 is implemented at the lower extremity of lower tube 204 of said substantially vertical support 201. It is configured to confer additional stability to safety apparatus in its ensemble, by way of transferring part of the weight of the safety apparatus in its ensemble to the lowest transversal pole 104 the base of said spring-loaded supporting foot is resting on.

As most of the total weight of the safety apparatus is in its ensemble it is supported by first and second fixing means of each substantially vertical supports 201 and 202, upon performing the length adjustment in order for supporting cable 203 to be adjusted to an appropriate height said spring-loaded supporting foot 1109 then rotates downward as it comes into contact with the underside of the next higher transversal pole, then slide along the external diameter of said pole in a sensibly vertical direction. Upon the extremity of said spring-loaded supporting foot 1109 having slid along the full external diameter of said next higher transversal pole, said extremity being now situated above next higher transversal pole, said spring action derived from the spring-loaded characteristic of said supporting foot actuate the rotation of said supporting foot back to a position sensibly perpendicular to substantially vertical support 201 and parallel to supporting cable 203. Said spring-loaded supporting foot 1109 can then support part of the weight of safety apparatus in its ensemble on said next, higher transversal pole. A spring-loaded foot 1110, identical in configuration, characteristics and function to spring-loaded supporting foot 1109, is implemented at the lower extremity of lower tube 206 of substantially vertical support 202, such that both substantially vertical supports 201, 202 are evenly supported in this way.

An alternative embodiment of the present invention exist wherein the lower and upper tube configuration of each said substantially vertical support remain identical in all points, however the upper extremities of upper tube 205 and 207 are configured to accommodate multiple supporting cables.

Figure 12:
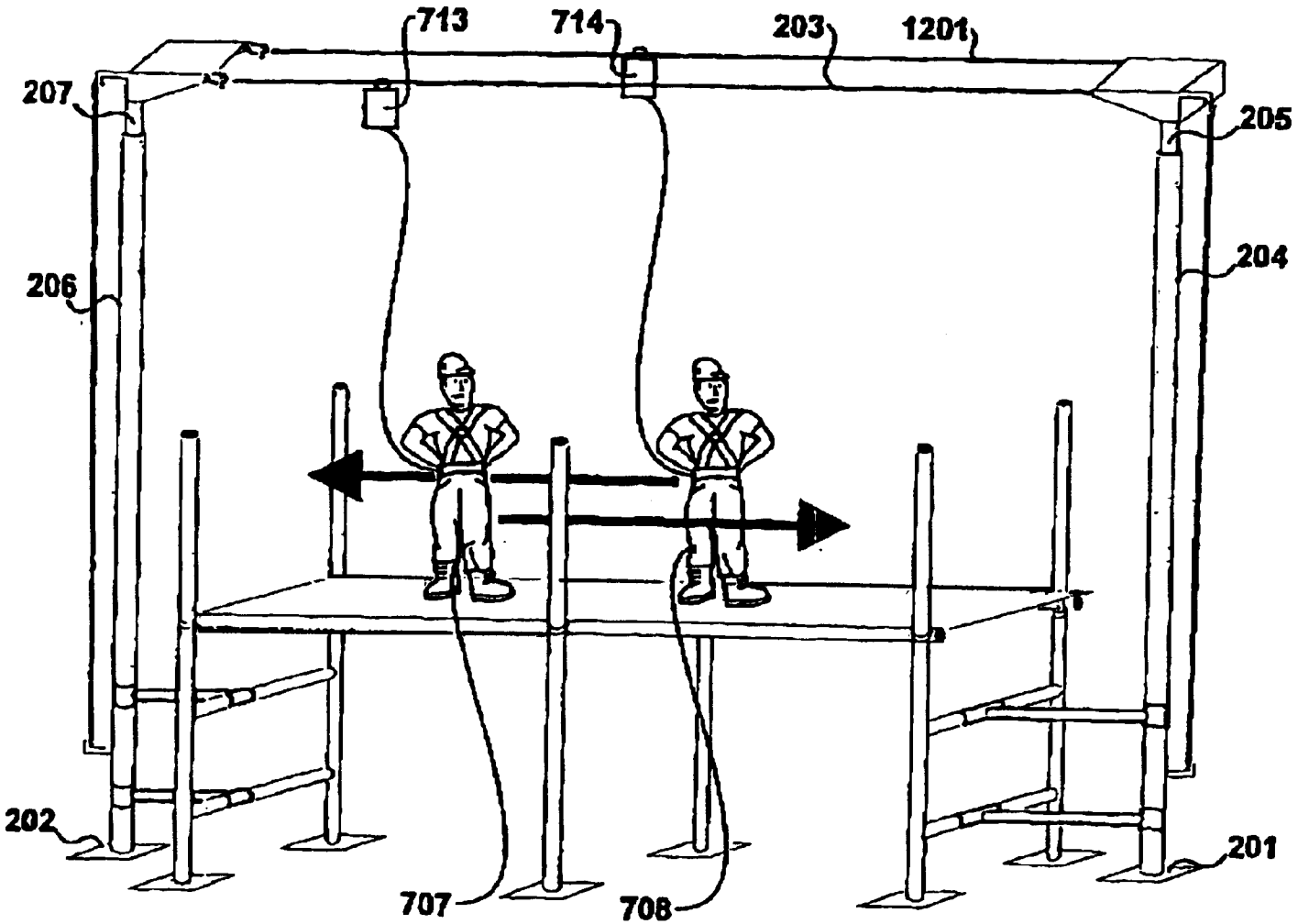
FIG. 12 illustrates an alternative embodiment of the invention, wherein multiple supporting cables are implemented.

For example, FIG. 12 illustrates the implementation of a second supporting cable 1201, which has been implemented between the first vertical support 201 and the second vertical support 202.

Upper extremity 209 of upper tube 207 features two sensibly parallel attachment means 304, wherein one attachment means provides safe anchoring for supporting cable 203 and the second attachment means, sensibly parallel to first attachment means 304, provides safe anchoring for second supporting cable 1201. Said supporting cables 304 and 1201 can be clamped by clamping devices 301 and 302.

Moreover, said clamping devices 301, 302, the components of which are described in detail in FIG. 4, can be adapted to accommodate multiple cables 203, 1201 by implementing as many individual ensembles of components necessary to the clamping of said cables as there are supporting cables. Said multiple ensembles of damping device components are sensibly parallel to one another and implemented side-be-sled on the upper tube.

The benefit of this alternative embodiment of the invention is to enable scaffolders or builders working on a same flat surface of a structure to cross one another's path without incurring the risk of entangling the cable attachment of their respective inertia reel and thereby unreeling said cable attachment further which, in the case of an accidental fall, would increase the pendulum effect affecting said falling scaffolder.

What is claimed is:

1. Safety apparatus for people working on a structure, comprising:

a first substantially vertical support comprising a lower part and an upper part movable with respect to said lower part such that said first support is adjustable in length;

said upper part and said lower part comprise an upper tube and a lower tube respectively;

said upper tube comprises an internal strengthening component and an external strengthening cable;

a tightening loop configured to tense said external strengthening cable and tension within said external strengthening cable being adjustable by said tightening loop;

first fixing means configured to attach said upper part to a structure;

second fixing means configured to attach said lower part to said structure; and a supporting cable extending from said upper part of said first support;

wherein said supporting cable is an overhead safety cable for tethering people;

when said apparatus supports said supporting cable at a lower height when said lower part is attached to a structure and said upper part is unattached; and when a length of said first support is increased and said upper part is attached to said structure, such that said apparatus supports said supporting cable at a higher height.

2. Apparatus according to claim 1, wherein said apparatus comprises a second substantially vertical support comprising:

a second lower part and a second upper part movable with respect to said second-lower part such that'said second support is adjustable in length;

third fixing means configured to attach said second upper part to a structure;

fourth fixing means configured to attach said second lower part to said structure; and said supporting cable extends between said first support and said second support.

3. Apparatus according to claim 1, wherein said lower tube has a first diameter, said upper tube has a second diameter and said first diameter is different from said second diameter so that said upper and lower tubes can slide vertically independently of one another.

4. Apparatus according to claim 2, wherein said supporting cable is one of multiple supporting cables extending between said first support and said second support.

5. Apparatus according to claim 2, wherein said first and second supports are configured to support said supporting cable while said second fixing means and said fourth fixing means are released and lengths of said first and second supports are adjusted to raise said lower part of said first support and said second lower part of said second support, and subsequently while said first fixing means and said third fixing means are released and said first upper part of said first support and said second upper part of said second support are raised.

6. Apparatus according to claim 1, wherein said apparatus further comprises cable-clamping devices configured to tense said supporting cable, and tension within said supporting cable is adjustable by said cable-clamping devices.

7. Safety apparatus for people working on a structure, comprising:

a first substantially vertical support comprising a first lower part and a first upper part movable with respect to said first lower part such that said first support is adjustable in length;

said first support further comprising a first spring-loaded foot attached to said first lower part such that when said first lower part is raised, said first spring-loaded foot rests on said structure;

first fixing means configured to attach said first upper part to a structure;

second fixing means configured to attach said first lower part to said structure;

a second substantially vertical support comprising a second lower part and a second upper part movable with respect to said second lower part such that said second support is adjustable in length;

said second support further comprising a second spring-loaded foot attached to said second lower part such that when said second lower part is raised, said second spring-loaded foot rests on said structure;

third fixing means configured to attach said second upper part to said structure;

fourth fixing means configured to attach said second lower part to said structure; and a supporting cable extending from said upper part of said first support and said supporting cable extending between said first support and said second support;

wherein said first support is configured to support said supporting cable while said second fixing means is released and a length of said first support is adjusted to raise said first lower part of said first support, and subsequently while said first fixing means is released and said first upper part is raised; and said second support is configured to support said supporting cable while said fourth fixing means is released and the length of said second support is adjusted to raise said second lower part of said second support, and subsequently while said third fixing means is released and said second upper part is raised.

8. Apparatus according to claim 7, wherein said first upper part and said first lower part comprise an upper tube and a lower tube respectively.

9. Apparatus according to claim 8, wherein said lower tube has a first diameter, said upper tube has a second diameter and said first diameter is different from said second diameter-so that said upper and lower tubes can slide vertically independently of one another.

10. Apparatus according to claim 7, wherein said supporting cable is one of multiple supporting cables extending between said first support and said second support.

11. Apparatus according to claim 7, wherein said apparatus further comprises cable-clamping devices configured to tense said supporting cable, and tension within said supporting cable is adjustable by means of said cable-clamping devices.

12. A method of erecting safety apparatus for people working on a structure, in which said safety apparatus comprises:

a first substantially vertical support comprising a lower part and an upper part movable with respect to said lower part such that said first support is adjustable in length;

said upper part and said lower part comprise an upper tube and a lower tube respectively;

said upper tube is equipped with an internal strengthening component and an external strengthening cable;

a tightening loop configured to tense said external strengthening cable, and tension within said external strengthening cable being adjustable by said tightening loop;

a first fixing means;

a second fixing means; and a supporting cable extending from said upper part; said method comprising the steps of:

attaching said lower part to a structure using said second fixing means such that said apparatus supports said supporting cable at a lower height while said upper part is unattached;

using said supporting cable as an overhead safety cable for tethering people; and adjusting a length of said vertical support and attaching said upper part to said structure using said first fixing means, such that said apparatus supports said supporting cable at a higher height.

13. A method of erecting safety apparatus according to claim 12, wherein said apparatus further comprises a second substantially vertical support comprising:

a second lower part and a second upper part movable with respect to said second lower part such that said second support is adjustable in length;

third fixing means configured to attach said second upper part to a structure;

fourth fixing means configured to attach said second lower part to said structure; and said supporting cable extends between said first support and said second support.

14. A method according to claim 13, wherein said method further comprises the step of extending multiple cables between said first support and said second support.

15. A method according to claim 13, comprising the further steps of:

releasing said second fixing means and said fourth fixing means and adjusting the length of said first support and said second support to raise said lower part of said first support and said second lower part of said second support; and releasing said first fixing means and said third fixing means and raising said first upper part of said first support and said second upper part of said second support.

16. A method according to claim 12, wherein said structure is a scaffold structure, and said method further comprises the additional step of implementing an additional higher level of scaffold, after performing said step of attaching said-lower part to said structure using said second fixing means such that said apparatus supports said supporting cable at a lower height while said upper part is unattached.

17. A method of erecting safety apparatus for people working on a structure, in which said safety apparatus comprises:

a first substantially vertical support comprising a first lower part and a first upper part movable with respect to said first lower part such that said first support is adjustable in length;

said first support further comprising a first spring-loaded foot attached to said first lower part such that when said first lower part is raised, said first spring-loaded foot rests on said structure;

a supporting cable extending from said first upper part;

a first fixing means;

a second fixing means;

a second substantially vertical support comprising a second lower part and a second upper part movable with respect to said lower part such that said second support is adjustable in length;

said second support further comprising a second spring-loaded foot attached to said second lower part such that when said second lower part is raised, said second spring-loaded foot rests on said structure;

a third fixing means configured to attach said second upper part to a structure;

a fourth fixing means configured to attach said second lower part to said structure;

said supporting cable extending between said first support and said second support;

said method comprising the steps of:

attaching said first lower part to a structure using said second fixing means such that said apparatus supports said supporting cable at a lower height while said first upper part is unattached;

using said supporting cable as an overhead safety cable for tethering people;

adjusting a length of said first support and attaching said first upper part to said structure using said first fixing means, such that said apparatus supports said supporting cable at a higher height;

releasing said second fixing means and said fourth fixing means and adjusting the length of said first support and said second support to raise said first lower part of said first support and said second lower part of said second support; and releasing said first fixing means and said third fixing means and adjusting the length of said first support and said second support to raise said first upper part of said first support and said second upper part of said second support.

18. A method according to claim 17, wherein said method further comprises the step of extending multiple cables between said first support and said second support.

19. A method according to claim 17, wherein said structure is a scaffold structure, and said method further comprises the additional step of implementing an additional higher level of scaffold, after performing said step of attaching said first lower part to said structure using said second fixing means such that said apparatus supports said supporting cable at a lower height while said first upper part is unattached.

* * * * *

UNITED STATES PATENT AND TRADEMARK OFFICE

CERTIFICATE OF CORRECTION

PATENT NO. : 6,776,259 B1
DATED : August 17, 2004
INVENTOR(S) : Stephen Murten

It is certified that error appears in the above-identified patent and that said Letters Patent is hereby corrected as shown below:

Column 3,
Line 29, change "arc" to -- and --;
Line 40, change "As" to -- its --;
Lines 57 and 58, change "damping" to -- clamping --;

Column 4,
Lines 22, 23, 29 and 31-32, change "damping" to -- clamping --;
Line 24, change “h” to -- it --;
Line 54, change "halt" to -- half --.

Column 5,
Line 24, change "erred" to -- referred --;
Line 57, change "toot" to -- foot --.

Column 6,
Line 12, after "fixing" delete "is";
Line 18, change "scaiolders" to -- scaffolders --.

Column 7,
Line 32, change "an" to -- on --;
Line 38, change "nurse" to -- course --.

Column 8,
Line 6, change "restive" to-- respective --.

Column 9,
Line 13, after "second" delete "is";
Line 59, change "exist" to -- exists --.

UNITED STATES PATENT AND TRADEMARK OFFICE

CERTIFICATE OF CORRECTION

PATENT NO. : 6,776,259 B1
DATED : August 17, 2004
INVENTOR(S) : Stephen Murten

It is certified that error appears in the above-identified patent and that said Letters Patent is hereby corrected as shown below:

Column 10,
Line 13, change "damping" to -- clamping --;
Line 15, change "side-be-sled" to -- side-be-side --.

Signed and Sealed this

Seventh Day of June, 2005

JON W. DUDAS
*Director of the United States Patent and Trademark Office*